United States Patent [19]

Thompson

[11] 4,396,356

[45] Aug. 2, 1983

[54] ASPIRATOR AND ASPIRATING SYSTEM

[76] Inventor: Lincoln Thompson, 26 Carriage Rd., Cheshire, Conn. 06410

[21] Appl. No.: 256,843

[22] Filed: Jan. 23, 1981

Related U.S. Application Data

[63] Continuation-in-part of Ser. No. 6,749, Jan. 26, 1979, abandoned.

[51] Int. Cl.[3] ..... F04F 5/48

[52] U.S. Cl. ..... 417/186; 417/189

[58] Field of Search ..... 417/151, 178, 181, 182, 417/185, 186, 187, 189, 196, 179, 180, 198

[56] References Cited

U.S. PATENT DOCUMENTS

| | | | |
|---|---|---|---|
| 314,237 | 3/1885 | Gorringe et al. | 417/189 |
| 1,369,398 | 2/1921 | Cartwright | 417/185 |
| 1,421,841 | 7/1922 | Schmidt | 417/189 X |
| 1,481,985 | 1/1924 | Chrisman | 417/185 |
| 2,582,069 | 1/1952 | Rose | 417/181 |
| 3,441,045 | 4/1969 | Malone | 417/189 X |
| 3,445,067 | 5/1969 | Sheldall | 417/181 X |
| 3,470,826 | 10/1969 | Foulds | 417/181 |
| 3,563,674 | 2/1971 | Moffat et al. | 417/151 X |
| 3,829,247 | 8/1974 | Edmonson | 417/182 |

FOREIGN PATENT DOCUMENTS

| | | | |
|---|---|---|---|
| 896302 | 11/1953 | Fed. Rep. of Germany | 417/185 |
| 810317 | 3/1937 | France | 417/185 |
| 492185 | 3/1954 | Italy | 417/186 |

*Primary Examiner*—Edward K. Look

[57] ABSTRACT

In an aspirator having convergent and divergent passage sections interconnected by an intermediate passage, the intermediate passage is characterized by an upstream portion having a constant first diameter, a downstream portion having a constant second diameter which is greater than the first diameter and an annular chamber at the junction of the upstream and downstream passage portions. The annular chamber has a diameter greater than that of the downstream portion and is coupled via a further passageway to a source of fluid to be aspirated. The aspirator may include a suction control in the form of a passage having at least a first valve therein for interconnecting the convergent and divergent passage portions and/or either the convergent or divergent passage portion to the annular chamber. The aspirator may also be provided with a pressure responsive valve positioned upstream of the convergent passage portion, the valve being responsive to pressure downstream of the aspirator for automatically controlling the rate of flow of fluid to the aspirator.

16 Claims, 10 Drawing Figures

PRESSURIZED WATER SUPPLY
OFF
HIGH

ASPIRATOR AND ASPIRATING SYSTEM

CROSS-REFERENCE TO RELATED APPLICATION

This is a continuation-in-part application of U.S. application Ser. No. 6,749 filed Jan. 26, 1979 now abandoned.

BACKGROUND OF THE INVENTION (1) Field of the Invention

The present invention relates to apparatus for mixing liquids. Specifically, the present invention is directed to an aspirator for mixing liquid fertilizers, insecticides and other liquid substances with water.

(2) Description of the Prior Art

Conventional aspirators are generally comprised of a tubular body. The inner diameter of the tubular body converges from the inlet end. The smaller diameter end of this convergent passage is connected to the first end of a second passage section which has a constant inner diameter. This constant diameter passage section either discharges fluid from its second end into the surrounding environment or into a divergent passage section. The result is that the velocity of a pressurized fluid passing through the tubular body is increased through the constant diameter section. As the velocity increases there is a corresponding drop in pressure.

A bore, which is provided in the tubular body, is coupled at a first end to the constant diameter section portion. This bore is also connected, at its other end, with another fluid source; i.e., liquid fertilizer or insecticide. As pressurized fluid, usually water, moves through the tubular body, a low pressure zone is induced within the bore. If the induced low pressure is less than the pressure of the other fluid source, that fluid is drawn through the bore and into the passageway. Thus the two fluids are mixed together and the mixture is discharged from the aspirator.

The typical aspirator is connected at its inlet end to a supply of pressurized water, via a hose for example, and has its discharge end connected to a load, such as a sprinkler or nozzle, by another hose. A major operational problem associated with prior aspirators results from the back pressure induced by the load. As the flow of water through the system is reduced by the load, back pressure builds in the aspirator; especially in the constant diameter portion. This back pressure reduces the velocity and increases the pressure in the constant diameter portion. The result is that the pressure at the discharge end of the bore may equal or exceed the pressure of the second fluid. Should this oxccur, little or no fluid is drawn up through the bore and mixed with the water. Any given aspirator which is inserted between the source of pressurized fluid and a load will cease to function at a predetermined back pressure created in the line by the load. This problem is aggravated when the load is an adjustable flow regulator.

Another problem with conventional aspirators is the lack of ability to regulate the amount of liquid being drawn up through the bore without resorting to small apertures which tend to clog. In conventional aspirators the amount of fluid being drawn up through the bore is a function of the supply pressure of the power stream, i.e., the pressure of the fluid at the inlet to the aspirator, and the amount of back pressure being induced by the load.

A still further problem with conventional aspirators is that they impose a sufficiently large load, in and of themselves, to impede the requisite flow rate when used in conjunction with a mechanically-oscillated lawn sprinkler.

SUMMARY OF THE PRESENT INVENTION

The present invention overcomes the above-discussed disadvantages and other deficiencies of the prior art by providing an aspirator which reduces the overall load on the system and allows regulation of the amount of fluid being drawn up through the bore. The present invention may also include means for reducing the effect of back pressure.

In accordance with the present invention an aspirator comprises a body having passageway extending therethrough. The passageway, which is preferably symmetrical with respect to an axis, includes a divergent inlet portion, an outlet portion and a short intermediate portion having a cross-sectional area which is sufficiently less than the cross-sectional area of the inlet end of the inlet portion. This is necessary to increase the velocity of the fluid through and thus cause a reduction of the pressure in the intermediate portion. The intermediate portion includes three sections of generally cylindrical shape. The intermediately disposed of these three sections defines a liquid delivering chamber which extends outwardly in a direction which is generally transverse to the axis of the passageway. This chamber provides for the delivery of liquid into the power stream about the entire periphery thereof A conduit or bore connects this chamber to the exterior of the body and provides for delivery of liquid to the chamber. The bore is connected to a reservoir which contains liquid fertilizer, insecticide or another substance which is desired to be mixed with the power stream.

In order to control or adjust the amount of fluid being drawn up through the bore, the pressure created in the bore must be controlled. This is accomplished in the present invention by numerous means. In one embodiment a by-pass channel is provided in the aspirator body which runs parallel with the intermediate portion of the passageway. This by-pass channel interconnects the inlet and outlet portions of the passageway and provides an alternate flow path for the power stream.

By controlling the flow through the bi-pass channel, the pressure drop across the intermediate portion of the aspirator passageway is controlled. Accordingly, the amount of fluid drawn up through the bore and mixed with the power stream may be regulated. The fluid which flows through the by-pass channel is added to the power stream and aspirated fluid mixture in the outlet portion and further reduces the concentration of the fluid within the water or other power stream fluid. Another embodiment which allows for the adjustment of pressure within the chamber involves interconnecting the chamber, circumscribes the intermediate portion, to either the outlet or inlet portions of the passageway with a channel. This interconnecting channel may be employed to controllably reduce the amount of pressure drop within the chamber by drawing off high pressure fluid from within the inlet or outlet portions of the passageway and delivering the thus withdrawn fluid to the chamber. By positioning a valve within this channel the reduction of the pressure drop within the chamber is made adjustable. As noted above, an aspirator is positioned between the source of pressurized fluid and the load, especially a flow regulator valve, the resulting back pressure can effect the amount of fluid drawn up through the bore. Even a minute reduction in flow can cause a significant amount of back pressure. In order to control the effect of back pressure and still allow effective control over the quantity of liquid aspirated into the power stream, a servo valve mechanism may be installed upstream of the inlet portion of the aspirator body in accordance with the invention. This servo valve mechanism is responsive to the back pressure in the line downstream of the aspirator. As the back pressure in this line increases, even by a small amount, the servo valve mechanism reduces the flow of fluid through the aspirator. When the back pressure in the line decreases the servo valve mechanism provides for an increased flow of fluid. It should be apparent that by diminishing the flow rate of the fluid through the system the back pressure induced by the load is also reduced and vice versa. This maintains the desired low pressure within the chamber and the continued mixing of the two fluids.

BRIEF DESCRIPTION OF THE DRAWING

The present invention may be better understood and its numerous objects and advantages will become apparent to those skilled in the art by reference to the accompanying drawings wherein like reference numerals refer to like elements in the several FIGURES, and wherein.

DESCRIPTION OF THE PREFERRED EMBODIMENT

Figures 1, 2, 3, 4:
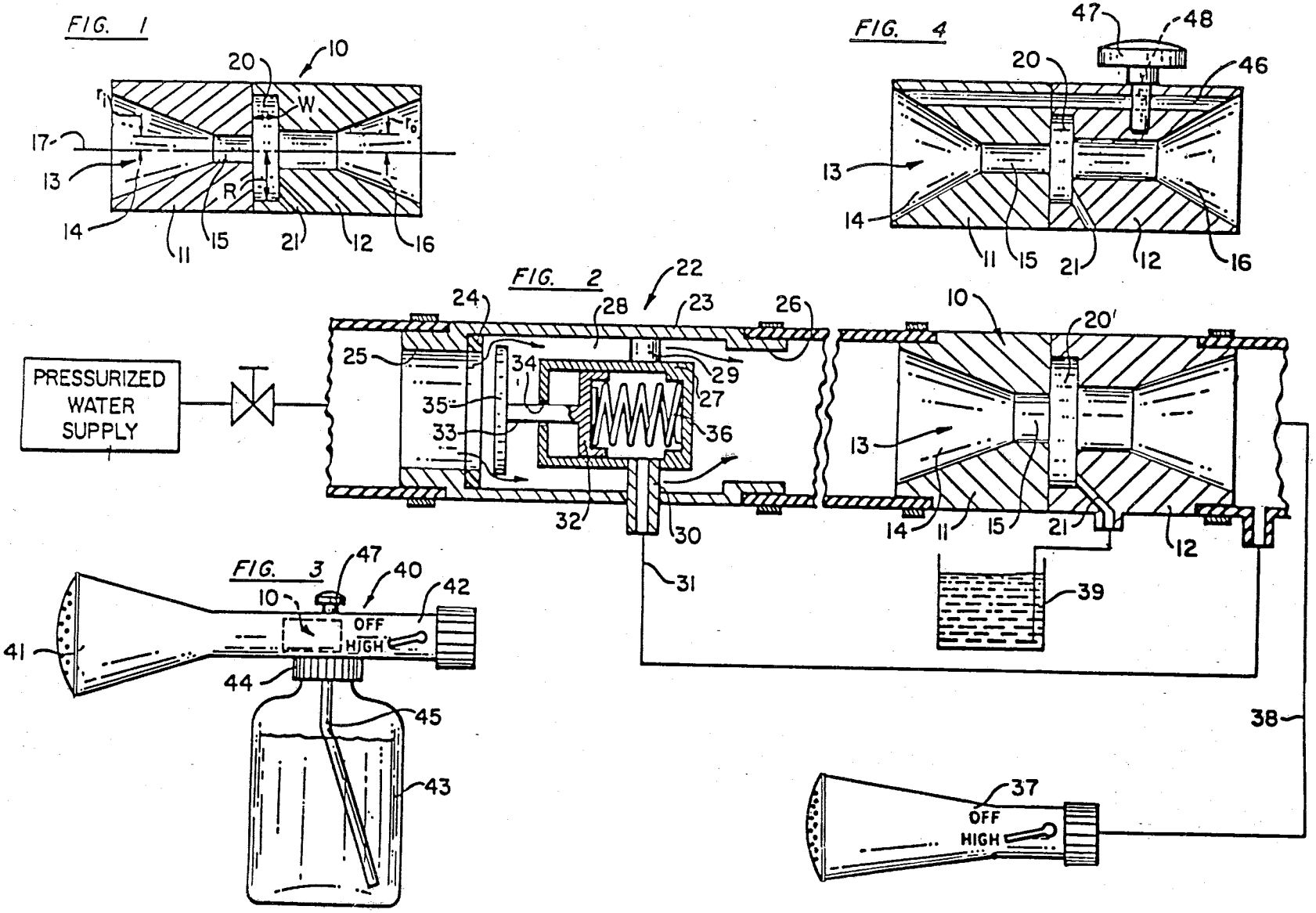
FIG. 1 is a cross-sectional side elevation view of an aspirator in accordance with one embodiment of the present invention.
FIG. 2 is a schematic diagram of an aspirating system including a servo valve mechanism in accordance with another embodiment of the present invention.
FIG. 3 is a schematic of a hose spray attachment including an aspirator in accordance with the present invention.
FIG. 4 is a cross-sectional side elevation view of still another embodiment of an aspirator in accordance with the present invention, the aspirator being of the type includng a by-pass channel and being suited for use in the attachment of FIG. 3.

Referring to FIG. 1, an aspirator 10 in accordance with one embodiment of the present invention comprises a body formed from the joinder of a first half 11 with a second half 12. Halves 11 and 12 are preferably made of plastic and the joinder of the two halves may be accomplished by means of chemical welding or by adhesive. The body includes a passageway 13 which extends through the body and includes an inlet portion 14, an intermediate portion 15 and an outlet portion 16. Passageway 13 defines an axis 17. The diameter of the inlet portion 14 of passageway 13 decreases towards the intermediate portion 15 of the passageway 13 thus forming a tapering or narrowing passageway. The intermediate portion 15 of passageway 13 is cylindrical and coaxial with respect to axis 17. The outlet portion 16 of passageway 13 diverges from the downstream end of intermediate portion 15.

The inlet portion 14 is connected to a source of pressurized fluid, preferably water. This pressurized fluid then flows as the power stream through the passageway 13 and is discharged from outlet portion 16. As the power stream flows through passageway 13 its velocity first increases, through inlet portion 15, until reaching a maximum velocity, in the intermediate portion 13, and then decreases outlet portion 16. The aspirator 10 is provided with means for drawing a second fluid into the intermediate portion 15 and mixing this second fluid with the power stream. To this end intermediate portion 15 includes a chamber 20 which extends generally radially outwardly with respect to axis 17. This chamber 20 has an annular shape and is symmetrical with respect axis 17. A fluid delivery passage 21 extends from the exterior of body 10 to chamber 20. The discharge end of passage 21 is connected to a source of fluid to be aspirated.

As stated above a fluid under pressure, preferably water, is delivered to inlet portion 14. As the resulting power stream flows through the passageway 13, the velocity increases to a maximum in the region of intermediate portion 15. As the velocity of the water increases the pressure decreases. As the power stream flows across chamber 20 the decreased pressure creates a partial vacuum. This partial vacuum draws fluid into chamber 20 through conduit 21 from a reservoir (not shown). The thus aspirated fluid then mixes with the power stream.

When a stream of water is discharged from an opening, the stream will gradually spread or fan out. As the stream enters chamber 20 it accordingly begins to spread out. Furthermore, the aspirated fluid being added to the power stream increases the cross-sectional area of the stream in chamber 20. Thus, is intermediate portion 15 had a constant diameter, the stream at the downstream of chamber 20 would contact the walls of chamber 20 and cause substantial turbulence. In order to prevent such turbulence the radius, $r_i$, of the intermediate portion 15 upstream of chamber 20 is slightly smaller than the radius, $r_o$, of the intermediate portion 15 which is downstream of chamber 20. Also in the interest of minimizing turbulence, the stream should enter the downstream portion of intermediate section 15 from chamber 20 as smoothly as possible. Accordingly, the radius, $r_o$, should not be too large or the width, W, of chamber 20 must be enlarged or the length of the intermediate section 15 must be increased. It should also be noted that the length of section 15 downstream of chamber 20 should be kept to a minimum to reduce the resistance to the flow. Thus there is an optimum relationship between $r_i$, $r_o$, and W.

One important application of the aspirator of the present invention is in the field of horticulture. Here the divergent portion 13 of the aspirator is connected to a standard one-half inch inner diameter hose which is connected to a faucet which supplies water at a pressure between approximately 30 and 60 psi. In one example where the aspirator is used in horticultural applications, the radius $r_i$ was 1/16 inch, W was ⅛ inch, radius $r_o$ was 5/64 inch, and the length of section 15 downstream of chamber 20 was ⅛ inch.

It is preferable to provide a one way check valve or similar device (not shown) in or in series with passage 21 to prevent the back flow of fluid from chamber 20 through conduit 21. Thus, when the system is properly functioning and a low pressure has been induced within chamber 20, fluid is drawn from a reservoir and into chamber 20 through passage 21. However, if the pressure within chamber 20 exceeds the pressure at the upstream end of passage 21 the check valve or similar device will prevent the flow of power stream fluid into the passage 21 and thus will prevent dilution of the fluid in the reservoir. The increase in pressure within chamber 20 may result from a substantial back pressure caused by a load downstream from the aspirator 10 or may result when the supply of pressurized fluid is suddenly interrupted.

It should thus be apparent that the aspirator 10 illustrated in FIG. 1 may deliver a consistent mixture of two fluids when positioned upstream of a constant load. This mixture will vary as a function of the pressure of the power stream fluid being delivered to the aspirator 10. This relationship is directly proportional in that as the power stream supply pressure increases the amount of fluid being drawn through passage 21 increases and vice-versa. Additionally, the stream of fluid passing through section 15 occludes fluid from chamber 20 at a rate proportional to its velocity. Furthermore, the amount of fluid being drawn up through passage 21 is proportional to the amount of back pressure being developed downstream from aspirator 10 by the load. As the back pressure increases the amount of fluid being drawn through passage 21 decreases and vice-versa.

As discussed earlier, at relatively high back pressure, the delivery rate of fluid through passage 21 is either reduced or terminated. The aspirating system shown in FIG. 2 reduces the amount of back pressure and its effect upon aspirator 10. The aspirating system shown in FIG. 2 is particularly suited for use with a hose connected at one end to a faucet and at the other end to a remote control valve which is adjustable, that is, a conventional nozzle which may be adjusted to provide for selection of a desired flow rate. The aspirating system includes an aspirator 10 is previously described and a servo control valve mechanism 22 positioned upstream of and in series relation to aspirator 10. Servo control valve mechanism 22 is responsive to the back pressure existing in the hose at a position downstream of aspirator 10 to provide for decreased volume flow as the back pressure in the line increases.

The servo control valve mechanism 22 will now be described in detail. Valve mechanism 22 comprises a casing 23 which has a generally cylindrical shape and which has an annular sealing ring 24 deposed adjacent inlet 25. Water flows from the pressurized power stream source faucet through inlet 25 and exits through outlet 26. A hydraulic or neumatic actuator mechanism is positioned within the chamber defined by cylindrical casing 23. This actuator mechanism includes a cylinder defining member 27 which is maintained in a stationary position by a support 29. An annular passageway 28 is defined by the cylindrical casing 23 and cylinder defining member 27. The interior of cylinder defining member 27 is in fluid communication with a portion of the hose which is positioned downstream of aspirator 10. A conduit 30 extends between the interior of cylinder defining member 27 and the outside of casing 23. An auxilliary hose 31, shown schematically, is connected between conduit 30 and a portion of the hose downstream of aspirator 10. Valve mechanism 22 further includes a piston 32, disposed in cylinder defining member 27, and a piston rod 33 which is moveable in response to the pressure existing within the cylinder of cylinder defining member 27. Piston rod 33 is sealed with respect to the cylinder defined by cylinder defining member 27 by an annular ring 34. A valve flap 35 is affixed to piston rod 33 and moves with respect to sealing ring 24. Spring 36 urges valve flap 35 toward the closed position.

Shown schematically is a remote control valve 37. Valve 37 is termed "remote" because this valve is separated from the aspirator 10 by the length of the hose 38. The remote control valve 37 provides for adjustment of the flow rate. Thus a person using the hose may adjust valve 37 to achieve a desired volume flow rate. The control valve 37 may be any of a number of conventional nozzles with an integral flow control valve. In the prior art, as the volume flow rate through nozzle 37 was decreased, the back pressure in the hose downstream of the aspirator would increase and the flow of aspirated fluid would be reduced or terminated. The aspirating system of the present invention provides for a reduction of the back pressure when the volume flow rate through the nozzle 37 is decreased. As shown in FIG. 2, the nozzle 37 is adjusted to provide for relatively free flow of water through the nozzle 37. As the volume flow rate through the nozzle 37 is reduced, a back pressure is created in the hose 38 downstream of aspirator 10. This portion of the hose is in fluid communication with the servo valve mechanism 22 via secondary conduit 31. Increased pressure within hose 38 results in increased pressure within the cylinder of cylinder defining member 27 and the piston rod 34 and the valve flap 35 are moved with the bias of spring 36 to reduce the volume flow rate through the servo valve mechanism 22. The back pressure within hose 38 is corresponding reduced and the aspiration of fluid through passage 21 is maintained.

Referring to FIG. 4, in order to control the concentration of the liquid being drawn through the passage 21, aspirator 10 is provided with a by-pass channel 46 which extends from the inlet portion 14 to the outlet portion 16. Flow through by-pass channel 46 may be controlled by means of a flow rate control valve 47 comprising a rotatable shaft having a through hole 48 extending transversely with respect to the axis thereof. By varying the alignment of hole 48 with the by-pass channel 46, the flow rate is controlled. When fluid is allowed to flow through the by-pass channel 46, the pressure drop across the chamber 20 is reduced since some of the liquid by passes intermediate portion 15. When the pressure drop is reduced, the rate of suction, i.e., the amount of liquid being drawn through passage 21, is reduced. Also, the concentration of the fluid from passage 21 is reduced by dilution. Thus, the consequences of adjusting control valve 17 are two-fold: the mixture exiting passageway 13 is diluted and the pressure drop across chamber 20 is reduced and thus the amount of the fluid delivered through passage 21 is reduced.

The aspirators shown in FIGS. 1 and 4 are relatively simple to fabricate. The halves 11 and 12 may be made from plastic material. The plastic material may be machined to form passageway 13 in, chamber 20 and passage conduit 21. Alternately, the halves 11 and 12 may be molded by a conventional process and passage 21 may be drilled subsequently. The body 10 can be made of any suitable plastic such as polycarbonate. Half 11 may be adhered to half 12 by chemical welding, that is, solvent welding. Alternately, an adhesive may be used to secure halves 11 and 12 together.

FIG. 3 depicts an adjustable remote mixer unit 40. Adjustable remote mixer unit 40 provides for an adjustable volume flow rate of liquid discharged through nozzle 41. Adjustable remote mixer unit 40 comprises a valve member 42 which provides for control of volume flow rate delivered to aspirator 10. The adjustable remote mixer unit includes a refillable reservoir 43 including a screw cap 44 and a fluid delivery conduit 45 which leads to fluid delivery passage 21 of aspirator 10. Since valve 42 is positioned upstream from aspirator 10, valve member 42 may be adjusted to reduce the volume flow rate without increasing the back pressure in the aspirator 10. Thus there is no need to provide the servo valve mechanism 22.

Figure 5:
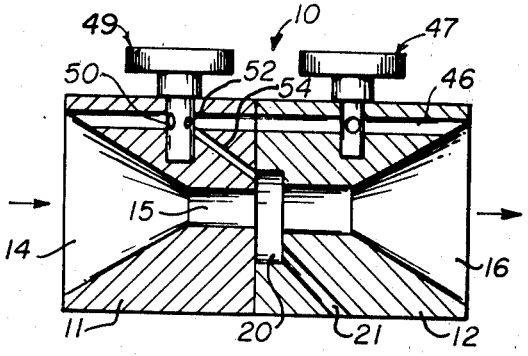
FIG. 5 is a cross-sectional side elevation view of still another embodiment of an aspirator in accordance with the present invention, the aspirator being of the type including a combination of a by-pass channel and an interconnecting channel between the chamber and the inlet portion.
Figure 6:
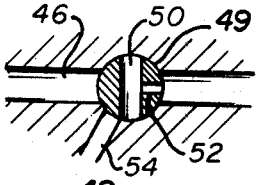
FIGS. 6–8 are schematic diagrams depicting operation of the control valve of the embodiment of FIG. 5.
Figure 7:
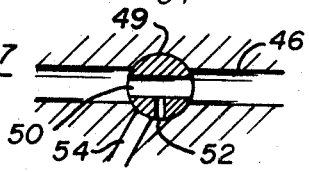
Figure 8:
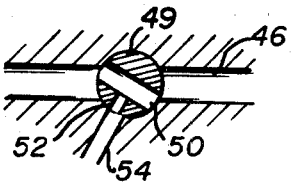

Another embodiment of an aspirator 10 is depicted in FIG. 5. This embodiment closely resembles the embodiment shown in FIG. 4, wherein the aspirator is provided with a by-pass channel 46 and a flow rate control valve 47. The aspirator 10 of the FIG. 5 embodiment is further provided with a second control valve 49 located upstream of valve 47. Control valve 49 is provided with a pair of transversely oriented holes 50 and 52 which may best be seen from FIGS. 6–8. Hole 50 may be aligned with the by-pass channel 46 and thus may be used in conjunction with valve 47 to regulate the flow of fluid through channel 46. Hole 52 communicates with the hole or passage 50 and may be employed to establish communication, via hole 50, with a further passage 54 provided in the aspirator body. Passage 54 extends from channel 46 to chamber 20. Valve 48 may be adjusted to provide fluid communication between chamber 20 and by-pass channel 46 via channel 54. THis results in the pressure within chamber 20 to be diminished. This lowering of the pressure within chamber 20 is a function of the pressure differential between the pressure in the convergent passage portion at the inlet end of channel 46 and the pressure in chamber 20. The pressure in chamber 20 may thus be increased and regulated by adjusting the positioning of holes 50 and 52. The various positions of holes 50 and 52 are better seen in the schematic drawings of FIGS. 6–8. As the valve 49 is rotated, the hole 50 may be aligned with channel 46 as seen in FIG. 7. Further rotation of valve 49 aligns both hole 50 with channel 46 and hole 52 with channel 54. Thus in the embodiment shown in FIG. 5 the pressure within chamber 20 may be regulated in two fashions: by utilizing the by-pass channel 46 or by adjusting the pressure differential between the inlet portion 14 and chamber 20 through channel 46 and passage 54.

Figure 9:
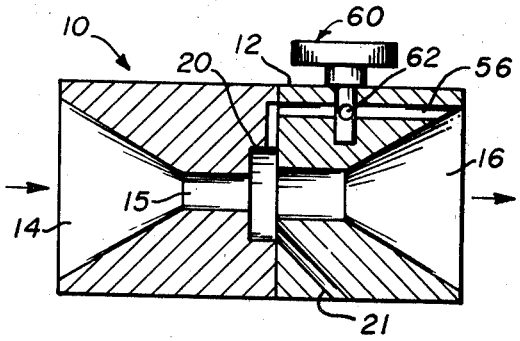
FIG. 9 is a cross-sectional side elevation view of still another embodiment of the present invention wherein the chamber surrounding the intermediate portion is interconnected with the outlet portion.
Figure 10:
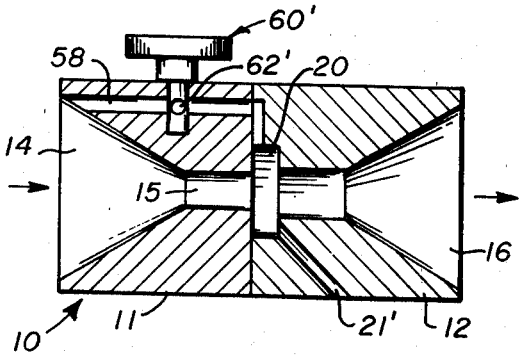
FIG. 10 is a cross-sectional side elevation view of still another embodiment of the present invention similar to the one shown in FIG. 9 except that the chamber is interconnected with the inlet portion.

Referring now to FIGS. 9 and 10 jointly, another embodiment of the present invention is seen. In this embodiment the aspirator 10 is constructed similar to the aspirator shown in FIG. 1. In addition a channel 56, as seen in FIG. 9, and a channel 58, as seen in FIG. 10, are provided interconnecting the chamber 20 with the outlet section 16 and inlet section 14, respectively. Channels 56 and 58 are respectively provided with a control valves 60 and 60'. These valves 60 and 60' have holes 62 and 62' which may be aligned with their respective channels 54 and 56. By properly aligning the holes 62 and 62' with their respective channels 56 and 58 a pressure differential is established between the ends of the channels 56 and 58. A low pressure is seen at the ends of the channels 56 and 58 which are adjacent the chamber 20 while the opposite ends of the channels 56 and 58 experience a higher pressure. The effect is a raising of the pressure within chamber 20. By adjusting the alignment of the holes 62 and 62' with their respective channels 56 and 58 the pressure within chamber 20 may be adjusted.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. An aspirator for mixing a pair of liquids, said aspirator being intended for connection between a pressurized source of a first fluid and a fluidic load, the load imposing a back pressure upon the aspirator, said aspirator comprising:

a body;

a main flow passage extending through said body, said main flow passage having an axis and first and second ends, said main flow passage further having sections which smoothly converge toward and diverge away from said axis, said convergent section directly communicating with said first end and being upstream of said divergent section, the minimum diameter of said convergent section being less than the minimum diameter of said divergent section, said convergent and divergent sections being spacially separated by and in fluid communication via an intermediate passage section, said intermediate passage section including a downstream portion and an upstream portion, the downstream end of said upstream portion having a diameter which is less than the upstream end of said downstream portion;

means for coupling said body to a source of a first pressurized liquid whereby said pressurized liquid may be delivered to said main flow passage convergent section;

means for coupling said body to a load whereby liquid exiting said main flow passage may be delivered to the load;

a chamber, said chamber in part defining said main flow passage and establishing fluid communication between said intermediate passage section upstream and downstream portions, said chamber being coaxial with said main flow passage and having a diameter greater than the minimum diameter of said divergent passage section;

means for establishing fluid communication between said chamber and a source of a second liquid, the flow of the first pressurized liquid through said main flow passage producing a pressure in said chamber which is less than the source pressure of the second liquid whereby the second liquid will be drawn into said chamber and mixed with the first liquid; and means for adjusting the pressure within said chamber, said adjusting means including a second passage having a smaller diameter than the minimum diameter of said main flow passage, said second passage connecting saaid chamber to a region of said main flow pressure wherein a pressure higher than the pressure in said intermediate passage section will normally exist, said adjusting means including first valve means which cooperates with said second passage.

2. The aspirator of claim 1 wherein said area of higher pressure to which said chamber is interconnected by said second passage is said convergent section.

3. The aspirator of claim 2 wherein said adjusting means first valve means varies the cross-sectional area of a portion of said second passage.

4. The aspirator of claim 3 further comprising:

second valve means positioned upstream of said main flow passage convergent section for controlling the volume flow rate of the first liquid; and valve control means connected to said second valve means, said valve control means being responsive to pressure downstream of said main flow passage divergent section to cause said second valve means to vary the flow rate of the first liquid inversely with changes in pressure downstream of said divergent section.

5. The aspirator of claim 4 wherein said coupling means includes a generally cylindrical casing defining a chamber having an inlet and outlet, said second valve control means comprises a hydraulic actuator including a cylinder and a resilently biased piston moveable therein, said piston having attached thereto a piston rod extending outwardly of said cylinder and said valve means includes a valve flap attached to said piston rod, said valve flap cooperating with the inlet of said cylindrical casing defined chamber to define a variable opening, the sensed pressure downstream of said main flow passage divergent section being delivered to said actuator cylinder to operate the piston therein.

6. The aspirator of claim 1 wherein said area of higher pressure to which said chamber is interconnected by said second passage is said divergent section.

7. The aspirator of claim 6 wherein said adjusting means first valve means varies the cross-sectional area of a portion of said second passage.

8. The aspirator of claim 7 furhter comprising:

second valve means positioned upstream of said main flow passage convergent section for controlling the volume flow rate of the first liquid; and valve control means connected to said second valve means, said valve control means being responsive to pressure downstream of said main flow passage divergent section to cause said second valve means to vary the flow rate of the first liquid inversely with changes in pressure downstream of said divergent section.

9. The aspirator of claim 8 wherein said coupling means includes a generally cylindrical casing defining a chamber having an inlet and outlet, said second valve control means comprises a hydraulic actuator including a cylinder and a resiliently biased piston moveable therein, said piston having attached thereto a piston rod extending outwardly of said cylinder and said valve means includes a valve flap attached to said piston rod, said valve flap cooperating with the inlet of said cylindrical casing defined chamber to define a variable opening, the sensed pressure downstream of said main flow passage divergent section being delivered to said actuator cylinder to operate the piston therein.

10. The aspirator of claim 1 wherein the minimum radius of said downstream portion of said intermediate passage section is less than the width of said chamber.

11. The aspirator of claim 10 wherein said downstream portion of said intermediate section has a smaller length than said upstream portion.

12. The aspirator of claim 1 wherein said downstream portion of said intermediate section has a smaller length than said upstream portion.

13. An aspirator for mixing a pair of liquids, said aspirator being intended for connection between a pressurized source of a first liquid and a fluidic load, the load imposing a back pressure upon the aspirator, said aspirator comprising:

a body;

a main flow passage extending through said body, said main flow passage having an axis and first and second ends, said main flow passage further having sections which smoothly converge toward and diverge away from said axis, said convergent section directly communicating with said first end and being upstream of said divergent section, the minimum radius of said convergent section being less than the minimum radius of said divergent section, said convergent and divergent sections being spacially separated by and in fluid communication via an intermediate passage section;

means for coupling said body to a source of a first pressurized liquid whereby said pressurized liquid may be delivered to said main flow passage convergent section;

means for connecting said body to a load whereby liquid exiting said main flow passage may be delivered to the load;

an annular chamber, said chamber being coaxial with said main flow passage and in direct radial communication with said main flow passage intermediate portion, said chamber having a diameter greater than the minimum diameter of said divergent passage section;

means for establishing fluid communication between said chamber and a source of a second liquid, the flow of the first pressurized liquid through said main flow passage producing a pressure in said chamber which is less than the source pressure of the second liquid whereby the second liquid will be drawn into said chamber and mixed with the first liquid;

means for adjusting the pressure within said chamber, said adjusting means including a second passage having a smaller diameter than the minimum diameter of said main flow passage, said second passage connecting said chamber to a region of said main flow passage where a pressure higher than the pressure in said intermediate passage section will normally exist, said adjusting means including first valve means which cooperates with said second passage;

second valve means positioned in said coupling means upstream of said main flow passage convergent section for controlling the volume flow rate of the first liquid; and valve control means connected to said second valve means, said valve control means being responsive to the pressure downstream of said main flow passage divergent section to cause said second valve means to vary the flow rate of said first liquid inversely with changes in pressure downstream of said divergent section.

14. The aspirator of claim 13 wherein said coupling means includes a generally cylindrical casing defining a chamber having an inlet and outlet, said second valve control means comprises a hydraulic actuator including a cylinder and a resilently biased piston moveable therein, said piston having attached thereto a piston rod extending outwardly of said cylinder and said valve means includes a valve flap attached to said piston rod, said valve flap cooperating with the inlet of said cylindrical casing defined chamber to define a variable opening, the sensed pressure downstream of said main flow passage divergent section being delivered to said actuator cylinder to operate the piston therein.

15. An aspirator for mixing a pair of liquids, said aspirator being intended for connection between a pressurized source of a first liquid and a fluidic load, the load imposing a back pressure upon the aspirator, said aspirator comprising;

a body;

a main flow passage extending through said body, said main flow passage having an axis and first and second ends, said main flow passage further having sections which smoothly converge toward and diverge away from said axis, said convergent section directly communicating with said first end and being upstream of said divergent section, the minimum radius of said convergent section being less than the minimum radius of said divergent section, said covergent and divergent sections being spacially separated by and in fluid communication via an intermediate passage section;

means for coupling said body to a source of a first pressurized liquid whereby said pressurized liquid may be delivered to said main flow passage divergent section;

means for connecting said body to a load whereby liquid exiting said main flow passage divergent section may be delivered to the load;

a chamber, said chamber being coaxial with said main flow passage and in direct radial communication with said main flow passage intermediate portion, said chamber having a diameter greater than the minimum diameter of said divergent passage section;

means for establishing communication between said chamber and a source of a second liquid, the flow of the first pressurized liquid through said main flow passage producing a pressure in said chamber which is less than the source pressure of the second liquid whereby the second liquid will be drawn into said chamber and mixed with the first fluid; and means for adjusting the pressure within said chamber, said adjusting means including a second passage having a smaller diameter than the minimum diameter of said main flow passage, said second passage extending between said main flow passage convergent and divergent sections, said adjusting means further including first valve means which cooperates with said second passage for varying the cross-sectional area of a portion of said second passage.

16. The aspirator of claim 15 wherein said main flow passage intermediate section comprises an upstream portion having a first diameter and a downstream portion having a second diameter which is greater than said first diameter, said upstream and downstream passage portions being in communication via said chamber whereby fluid discharged from said upstream passage portion will be projected across said chamber to said larger diameter downstream passage portion.

* * * * *